US009145892B2

(12) United States Patent
Kawabata et al.

(10) Patent No.: US 9,145,892 B2
(45) Date of Patent: Sep. 29, 2015

(54) WATER INJECTED SCROLL AIR COMPRESSOR

(71) Applicant: Hitachi Industrial Equipment Systems Co., Ltd., Chiyoda-ku, Tokyo (JP)

(72) Inventors: Natsuki Kawabata, Shizuoka (JP); Kazuaki Shiinoki, Yokohama (JP); Hirotaka Kameya, Rifu (JP); Masakazu Aoki, Shizuoka (JP)

(73) Assignee: Hitachi Industrial Equipment Systems, Co., Ltd., Tokyo (JP)

( * ) Notice: Subject to any disclaimer, the term of this patent is extended or adjusted under 35 U.S.C. 154(b) by 101 days.

(21) Appl. No.: 14/168,772

(22) Filed: Jan. 30, 2014

(65) Prior Publication Data

US 2014/0147325 A1 May 29, 2014

Related U.S. Application Data

(63) Continuation of application No. 13/024,123, filed on Feb. 9, 2011, now Pat. No. 8,672,647.

(30) Foreign Application Priority Data

Feb. 10, 2010 (JP) ..... 2010-027101

(51) Int. Cl.
*F04C 18/02* (2006.01)
*F04C 28/06* (2006.01)
(Continued)

(52) U.S. Cl.
CPC ..... *F04C 18/0215* (2013.01); *F04C 18/0223* (2013.01); *F04C 28/06* (2013.01);
(Continued)

(58) Field of Classification Search
CPC ..... F04C 18/0215; F04C 18/0223; F04C 2270/19; F04C 2270/80; F04C 28/06; F04C 28/08; F04C 28/24; F04C 29/042
USPC ..... 417/212, 213, 410.5; 418/55.1–55.6
See application file for complete search history.

(56) References Cited

U.S. PATENT DOCUMENTS 3,975,123 A * 8/1976 Schibbye ..... 418/97
5,358,387 A * 10/1994 Suzuki et al. ..... 417/295
(Continued)

FOREIGN PATENT DOCUMENTS

JP 8-128395 A 5/1996
JP 10-77980 A 3/1998
(Continued)

OTHER PUBLICATIONS

T. Yanagisawa, et al., "Performance of oil-free scroll-type air compressors", Department of Mechanical Engineering, Shizuoka University, Japan, Institute of Mechanical Engineers (IMechE) , Sep. 1999, pp. 279-287 (Nine (9) pages).
(Continued)

*Primary Examiner* — Peter J Bertheaud
*Assistant Examiner* — Dominick L Plakkoottam
(74) *Attorney, Agent, or Firm* — Crowell & Moring LLP

(57) ABSTRACT

A high reliability water injected scroll air compressor is provided with an orbiting scroll, a fixed scroll corresponding to the orbiting scroll, a motor that generates driving force for making the orbiting scroll orbit the fixed scroll, a compressing path from a suction port to a discharge port, and a portion for injecting water into the compressing path. The operation is controlled by a switching operation in which water is injected into the compressing path and then no water is injected. Corrosion, failure of activation, and concerns about wrap contact when water is injected into an air end are avoided by switching the operation with water injection and the operation without water injection so as to prevent water from remaining in the air end.

16 Claims, 11 Drawing Sheets

(51) Int. Cl.

| | |
|---|---|
| ***F04C 29/04*** | (2006.01) |
| *F04C 28/08* | (2006.01) |
| *F04C 28/24* | (2006.01) |

(52) U.S. Cl.
CPC ..... *F04C 29/042* (2013.01); *F04C 28/08* (2013.01); *F04C 28/24* (2013.01); *F04C 2270/19* (2013.01); *F04C 2270/80* (2013.01)

(56) References Cited

U.S. PATENT DOCUMENTS

| | | | | |
|---|---|---|---|---|
| 5,640,854 | A * | 6/1997 | Fogt et al. | 62/197 |
| 5,690,480 | A * | 11/1997 | Suzuki et al. | 418/55.2 |
| 5,755,564 | A * | 5/1998 | Machida et al. | 418/55.2 |
| 6,123,529 | A * | 9/2000 | Kawano et al. | 418/55.2 |
| 6,268,074 | B1 * | 7/2001 | Siepierski et al. | 429/416 |
| 6,672,846 | B2 * | 1/2004 | Rajendran et al. | 417/410.5 |
| 2004/0140018 | A1 * | 7/2004 | Sato et al. | 148/417 |
| 2004/0191100 | A1 | 9/2004 | Nakane et al. | |
| 2008/0089795 | A1 | 4/2008 | Takeda et al. | |
| 2008/0166253 | A1 | 7/2008 | Fujimoto et al. | |
| 2010/0158733 | A1 * | 6/2010 | Kohsokabe et al. | 418/55.6 |
| 2010/0233004 | A1 * | 9/2010 | Matsuzaka et al. | 418/84 |
| 2010/0287943 | A1 * | 11/2010 | McMahan et al. | 60/772 |

FOREIGN PATENT DOCUMENTS

| | | | |
|---|---|---|---|
| JP | 2001-355588 | A | 12/2001 |
| JP | 2002-83618 | A | 3/2002 |
| JP | 2002-89447 | A | 3/2002 |
| JP | 2004-301085 | A | 10/2004 |
| JP | 2007-262924 | A | 10/2007 |
| JP | 2008-75618 | A | 4/2008 |
| JP | 2008-95643 | A | 4/2008 |
| JP | 2008-163926 | A | 7/2008 |
| JP | 2008-185039 | A | 8/2008 |
| JP | 2008-248763 | A | 10/2008 |
| JP | 2009-180099 | A | 8/2009 |
| JP | 2009-180134 | A | 8/2009 |
| JP | 2010-144709 | A | 7/2010 |

OTHER PUBLICATIONS

Japanese Office Action (English translation only) dated Sep. 3, 2013 (eight (8) pages).
U.S. Appl. No. 13/025,460, filed Feb. 11, 2011.

* cited by examiner

WATER INJECTED SCROLL AIR COMPRESSOR

This application is a continuation of U.S. patent application Ser. No. 13/024,123, filed Feb. 9, 2011, the entire disclosure of which is incorporated herein by reference, which claims the priority of Japanese Patent Application No. JP 2010-027101, filed Feb. 10, 2010, the priority of which is also claimed here.

TECHNICAL FIELD

This subject matter relates to a scroll air compressor that compresses air, particularly relates to a water injected scroll air compressor of a type that water is injected into the compression chamber.

BACKGROUND

For a portion to enhance the energy efficiency of an air compressor for general industry, an oil injected type and a water injected type that mix oil or water with air sucked inside a air end and compress them together are known.

The oil or the water has effect that inside leakage is reduced because it seals narrow clearance via which compression chamber connects with another space and effect that the heat of compression is absorbed and the thermic deformation of members of the compressor is prevented, reducing compressing power, and both effects enhance the energy efficiency. The oil injected type excels in reliability because the type has many achievements, however, as a component of oil remains in supplied discharged air though the component is slight, the oil injected type is often not used for application that does not allow even the existence of the minute oil component to food and a semiconductor.

The prevalence of the water injected type has been retarded, compared with the oil injected type because countermeasures against rust, corrosion, the failure of lubrication and others are required, compared with oil because of characteristics of water though no oil content is mixed in supplied air as to the water injected type. However, the development of a water injected air compressor has been recently active because of a request of a market for clean air that includes no oil content and for example, Japanese Patent Application Laid-Open Publication No. 2009-180099 is disclosed.

The adoption of a water injected scroll air compressor is disclosed in Japanese Patent Application Laid-Open Publication No. H8-128395 and Japanese Patent Application Laid-Open Publication No. 2002-89447. Besides, results of experiments in which the efficiency is enhanced by injecting water into the scroll air compressor are described in "Performance of oil-free scroll-type air compressors" written by T. Yanagisawa, M. Fukuta, and Y. Ogi (Shizuoka University) in Proceedings of International Conference on Compressors and Their Systems as an identification number of IMechE 1999 C542/088, issued in September, 1999 and published by Institution of Mechanical Engineers (IMechE).

SUMMARY

In the case of an oil-free water injected scroll air compressor, at least the following three problems are supposed and its product planning does not progress, compared with a screw type.

(1) As an aluminum alloy the density of which is small and which is excellent in thermal conductivity is used for the material of a scroll because of a dimensional constraint of a balance weight and characteristics of heat radiation, the corrosion of the material when water is injected is worried.

(2) As compression chamber radially moves from the periphery toward the center along a scroll wrap, reducing its radius, injected water itself causes uncertain unbalance.

(3) As there is a limit in thickening the wrap because of a shape of the scroll air compressor and tolerance decreases in the strength of the wrap particularly in the center, the breakage of the wrap may be caused when injected water is compressed.

Besides, problems to be particularly solved by the present subject matters are as follows.

(4) When water remains in the compression chamber in activation, the activation fails because of excessive torque caused by the compression of the liquid, the scroll wraps are touched because of a thermal transient state, unbalance is caused, and vibration is increased.

(5) When water remains in the compression chamber in a stop, an orbiting scroll and a fixed scroll respectively made of an aluminum alloy for example may corrode.

The present subject matter is made in view of the above-mentioned problems and its object is to avoid the failure of activation caused by the injection of water and a problem that the material of the scroll corrodes due to water left in compression chamber in a stop and to provide a water injected scroll air compressor that enables stable operation and has high reliability.

(1) To achieve the object, the present subject matter is based upon a scroll air compressor which is provided with an orbiting scroll member equipped with a scroll wrap, a fixed scroll member equipped with a substantial scroll wrap corresponding to the wrap of the orbiting scroll member, and a driving unit that generates driving force for making the orbiting scroll member orbit the fixed scroll member. The scroll air compressor is provided with a compressing path from a suction port to a discharge port and in which water is injected into the compressing path, and has a characteristic that the operation is initiated without injecting water (hereinafter called operation without water injection) and the injection of water is initiated after certain time elapses since the initiation of the operation (hereinafter called operation with water injection).

Besides, the present subject matter is provided with a portion to detect at least either of the temperature or the pressure of compressed gas discharged from the compressing path, is also provided with a portion to operate the detecting portion and operating time, and during the operation, operation with water injection may be also initiated based upon a result of operation using at least one parameter of the pressure, the temperature and the operating time.

(2) To achieve the object, the present subject matter is based upon the scroll air compressor which is provided with the orbiting scroll member equipped with the scroll wrap, the fixed scroll member equipped with the substantial scroll wrap corresponding to the wrap of the orbiting scroll member, and the driving unit that generates driving force for making the orbiting scroll member orbit the fixed scroll member. The scroll air compressor is provided with the compressing path from the suction port to the discharge port and in which water is injected into the compressing path, and has a characteristic that at the same time that the driving unit is stopped, the injection of water is stopped or before the driving unit is stopped, operation without water injection is executed.

Besides, a portion to detect at least either of the temperature or the pressure of compressed gas discharged from the compressing path is provided, a portion to operate the detecting portion and operating time is also provided, and during the operation, the injection of water into the compressing path may be also stopped or reduced based upon a result of operation using at least one parameter of the pressure, the temperature and the operating time.

For example, line pressure is detected, it is estimated based upon its value and the variation that the compressor is automatically stopped, and the injection of water is stopped before the compressor is stopped. At this time, the quantity of injected water may be also gradually reduced based upon a value of the pressure and the variation. When line pressure rapidly decreases and the compressor is not automatically stopped to the contrary to the estimate, operation with water injection is resumed based upon pressure or the elapse of time respectively separately determined.

Besides, for example, when no external air vessel is provided and pressure rapidly varies, water may be also ordinarily stopped.

Hereby, in the stop, water is lost in the compression chamber and the corrosion of the material of the scroll and a problem in activation can be avoided. Particularly, when the material of the scroll is made of an aluminum alloy, the protection against corrosion of the compressor is enhanced.

(3) In (1) and (2) described above, it is desirable that a variable frequency drive is provided for the following reasons.

For example, when the injection of water is stopped to be operation without water injection during the operation of the compressor because discharge pressure rises and the driving unit is stopped after the compression chamber is dried, it is supposed that the pressure exceeds set cut-out pressure before the compression chamber is fully dried, a relief valve is operated and a protective device such as a thermal relay is operated. Besides, to avoid this situation, the compressor is stopped before the compression chamber is fully dried. According to research by the inventors, drying operation for approximately one minute is required so as to dry the compression chamber, while in a case that compressed fluid is air, sufficient drying time cannot be secured in the currently normal combination of a compressor and an air vessel (the air vessel of approximately 0.1 to 0.2 $m^3$ for the compressor of a flow amount of 1 $m^3$/min. in conversion in a suction condition). Then, when a usage rate of compressed fluid is low, energy saving operation according to the usage rate of air is enabled by using the variable frequency drive, controlling so that the rotating speed of the driving unit is reduced and the compressor is not stopped as much as possible.

Besides, to more effectively stop the compressor in a dry condition, when the rotating speed of the driving unit decreases to some extent, the injection of water may be also stopped to be operation without water injection.

(4) In (1) to (3) described above, a check valve or a minimum pressure valve is provided on the path where air of the compressor passes and as a result, after the injection of water into the compressing path is stopped during operation, the operation (hereinafter called unload operation without water injection) is continued, blow-off air on the primary side of the check valve or the minimum pressure valve into the atmosphere. Hereby, operation without water injection is enabled without operating the protective device described in (3), besides, when a compressed air flow rate is increased during operation without water injection, the supply of compressed air can be resumed by stopping the blow-off of air, and when the compressed air flow rate is further increased, the injection of water into the compression chamber can be also resumed.

Further, when an air flow rate is small and an automatic stop is continued for long time, unload operation without water injection is executed for fixed time and the compression chamber is dried.

(5) In (1) to (4) described above, a suction throttle valve is provided on the suction side of the compressor, as a result, inlet pressure in the compression chamber is turned negative by closing the suction throttle valve in operation without water injection before the compressor is stopped, and the compression chamber can be faster dried. When the blow-off of air is executed while the suction throttle valve is closed, compression ratio decreases, power is reduced, and the rise of discharge temperature can be reduced.

(6) In (4) and (5) described above, as blow-off air may include moisture, a circumference of the compressor can be protected by utilizing a water separator before the blow-off.

(7) In (1) to (6) described above, pressure when operation without water injection is initiated is set to be equal to or lower than the cut-out pressure.

(8) In (1) to (7) described above, the injection of water and a stop of the driving unit are simultaneously executed in capacity control, that is, in an automatic stop according to line pressure and if operation without water injection is executed only in a stop not necessarily linked with the variation of line pressure such as a stop instruction from the field, a stop instruction depending upon multi unit control and a stop instruction depending upon scheduled operation, more energy can be saved.

(9) In some described above, the driving unit that generates driving force for making the orbiting scroll member orbit shall be a motor.

(10) In some described above, when an automatically stopped condition is continued, operation without water injection is executed for fixed time and blow-off air shall be blown into the atmosphere from the primary side of the check valve or the minimum pressure valve.

According to the above-mentioned examples, the failure of activation caused by the injection of water and a problem that the material of the scroll is corroded by water left in the compression chamber in a stop can be avoided by suitably executing operation without water injection.

According to the present subject matter, the water injected scroll air compressor that enables stable operation and has high reliability can be provided.

BRIEF DESCRIPTION OF THE DRAWINGS

The present subject matter will become fully understood from the detailed description given hereinafter and the accompanying drawings, wherein.

DETAILED DESCRIPTION

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and/or circuitry have been described at a relatively high-level, without detail, in order to avoid unnecessarily obscuring aspects of the present teachings.

Hereinafter, examples of the present subject matter will be described with reference to the accompanying drawings.

Figure 1:
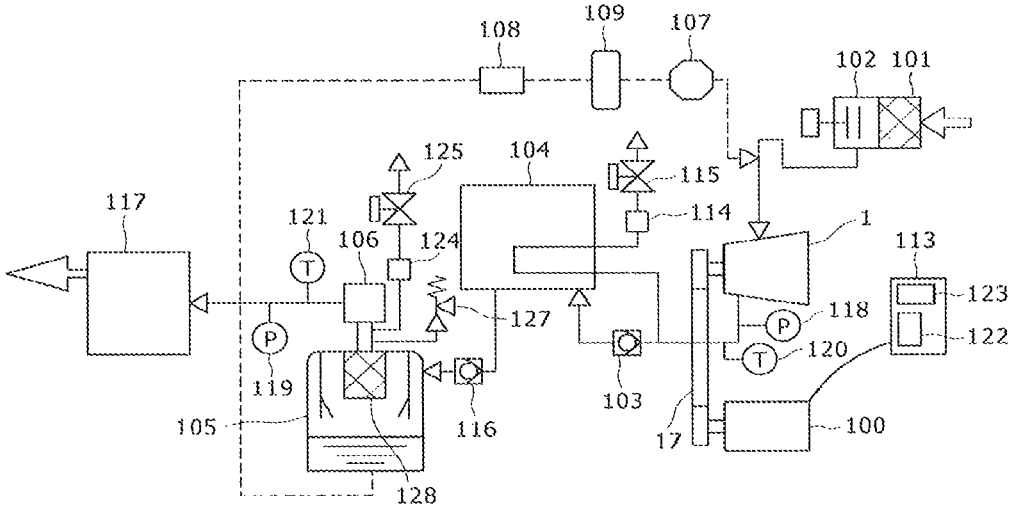
FIG. 1 is a block diagram showing a compressor in an example of the present subject matter.

FIG. 1 is a system diagram showing the whole configuration of a water injected scroll air compressor equivalent to this example. As described later, the whole is not essential configuration, however, desired effects are acquired by controlling specific configuration every example.

Figure 2:
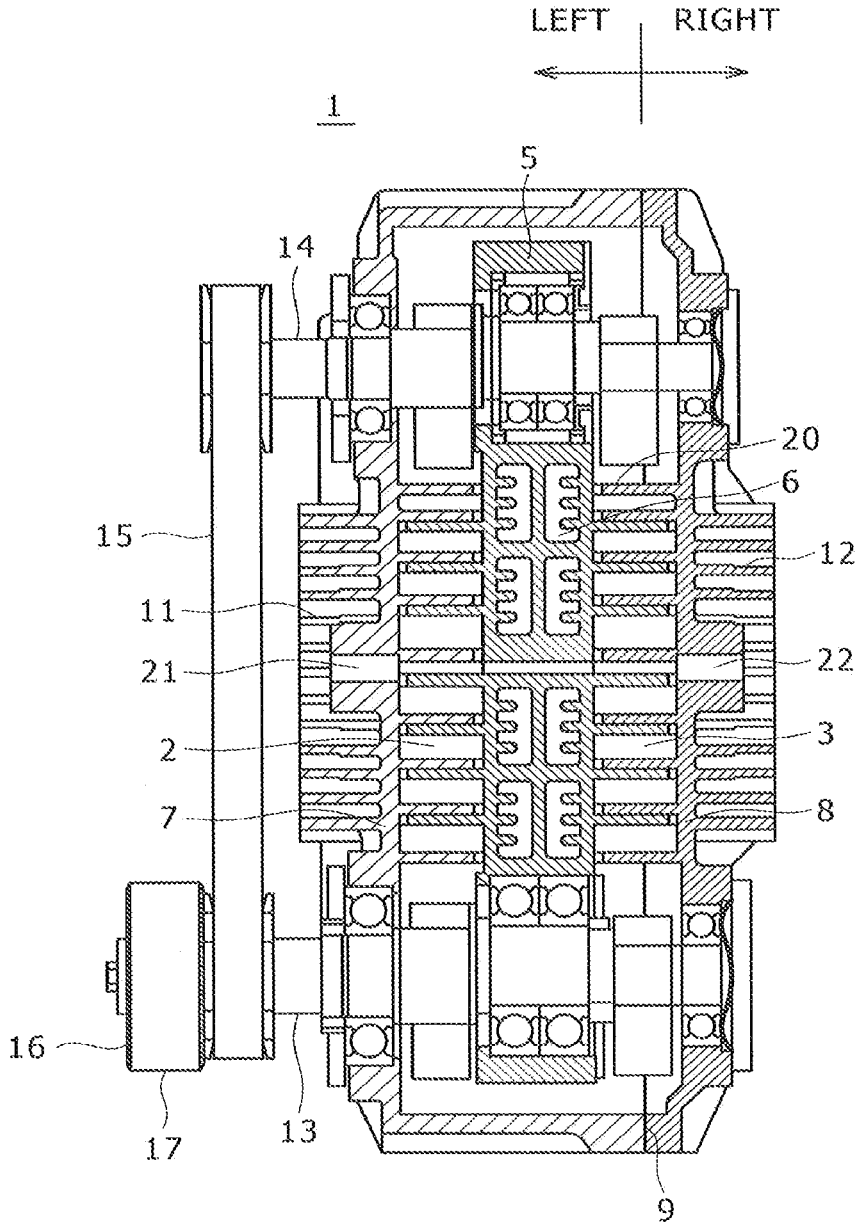
FIG. 2 is a top sectional view showing the scroll air compressor in the example of the present subject matter.
Figure 3:
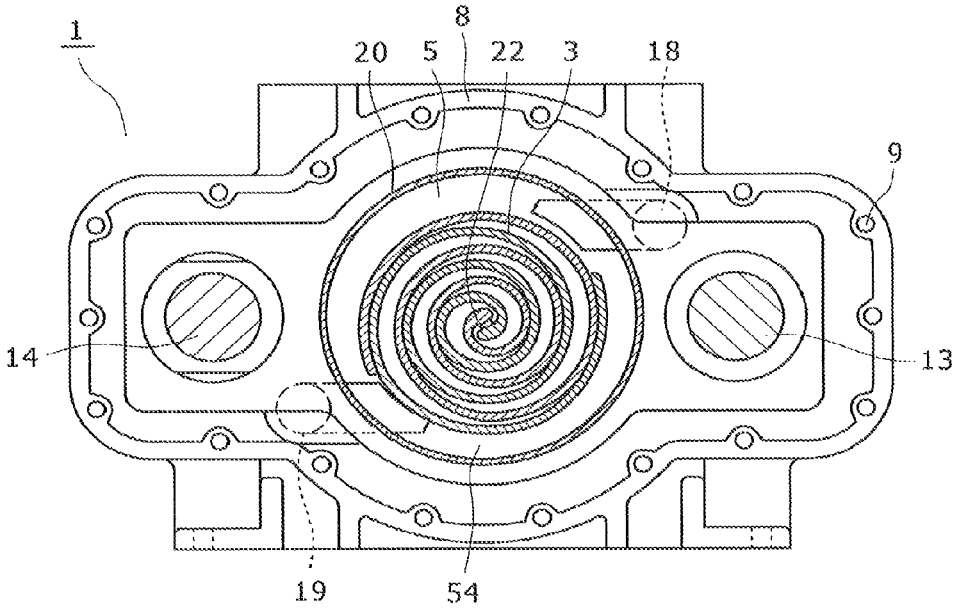
FIG. 3 is a side sectional view showing the scroll air compressor in the example of the present subject matter.

FIG. 2 is a top sectional view showing an air end of the scroll air compressor and FIG. 3 is a side sectional view showing the air end of the scroll air compressor.

Figure 4:
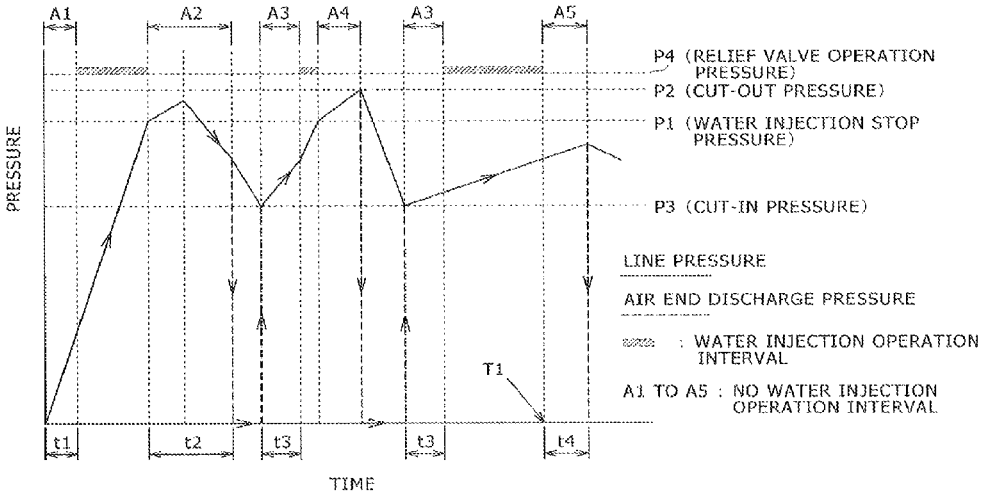
FIG. 4 is a time chart in a first example of control in this example.
Figure 5:
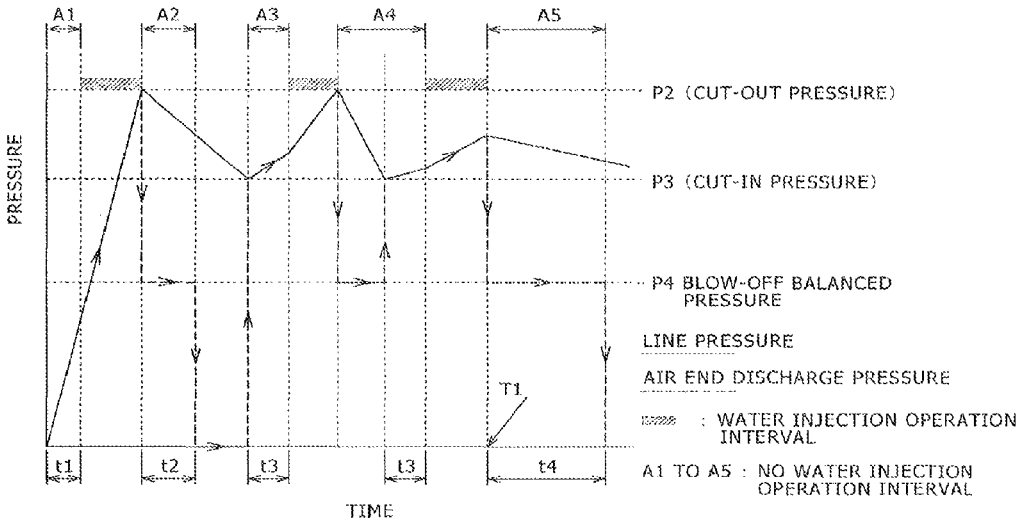
FIG. 5 is a time chart in a second example of control in this example.
Figure 6:
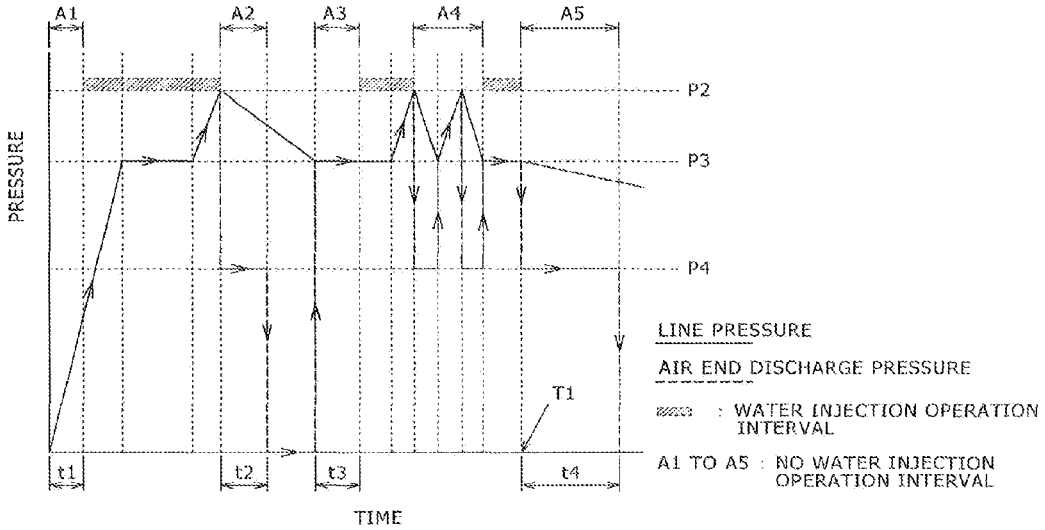
FIG. 6 is a time chart in a third example of control in this example.

FIGS. 4 to 6 show examples of an operational time chart of the water injected scroll air compressor and FIGS. 7 to 11 show examples of a control flow chart.

Before the whole configuration is described, the structure of the air end 1 of the scroll air compressor will be described using FIGS. 2 and 3.

The air end 1 of the scroll air compressor is provided with left and right two scroll mechanisms 2, 3 and each scroll mechanism is configured by a wrap on the orbiting side, a wrap on the fixed side and end plates equivalent to bottoms of the wraps. The left and right two wraps on the orbiting side are formed back to back with the same orbiting scroll 5 and in the center of the orbiting scroll 5 held between the end plates of both wraps, a through hole 6 for letting cooling air pass is provided.

The wrap on the fixed side engaged with the wrap of the orbiting scroll 5 is formed inside a left fixed scroll 7 and inside a right fixed scroll 8 and these left and right two fixed scrolls are connected by bolts in a peripheral connecting part 9 to be a casing of the air end 1. Each cooling fin 11, 12 is formed on a surface to be the reverse surface to the wrap provided inside each fixed scroll 7, 8.

The orbiting scroll 5 is supported by each eccentric part of a main shaft 13 and a countershaft 14 via each bearing outside the wraps. The eccentricity of the two shafts is the same and a link mechanism configured by parallel four poles is formed. The main shaft 13 and the countershaft 14 are supported by the casing via bearings and are synchronously rotated by the effect of a timing belt 15 wound onto synchronous pulleys provided to ends of them. For a driving unit in this example, a motor 100 (FIG. 1) is used and the main shaft 13 receives power from an output shaft of the motor 100 via a belt 17 wound onto a driving pulley 16.

Suction ports 18, 19 that pierce each wall are provided just outside the wrap of each fixed scroll 7, 8. As the two suction ports are arranged on one side, the total right and left four suction ports are provided. A passage that ranges from the outside to the inside of the casing through the suction ports 18, 19 continues to the inside of a dust seal 20 and connects with a peripheral room 54 that surrounds the wrap. The dust seal 20 is attached to ends of a cylindrical wall that overhangs inside the left and right fixed scrolls 7, 8 and that surrounds the wrap and is slid in the vicinity of the periphery of the end plate of the orbiting scroll 5. The dust seal 20 is attached to prevent foreign matters from invading compression chamber.

Each discharge port 21, 22 that pierces each fixed scroll 7, 8 so as to make the compression chamber at a final stage and the outside communicate is provided in the center of each left or right wrap. To balance the left and right compression chamber, a pipe line that makes the two discharge ports 21, 22 communicate by piercing the center of the orbiting scroll 5 is provided.

According to the above-mentioned configuration, the orbiting scroll 5 is orbited by the motor 100 and air sucked from the suction ports 18, 19 is compressed by the scroll mechanisms 2, 3. The compressed air is discharged from the discharge ports 21, 22 and is supplied to the outside via a passage described later.

Referring to FIG. 1, the whole configuration of this example will be described below.

The air end 1 is configured by combining scroll members provided with the scrolled wrap and has structure that air is sucked from the suction port and water can be injected into the compression chamber together with the air for example. Besides, the air end is configured via optimum clearance to enable operation in an oil-free state.

Compressed fluid flows as follows.

A suction filter 101 is provided on the suction side of the air end 1 and a suction throttle valve 102 for regulating capacity may be also provided on the secondary side.

Fluid compressed in the air end 1 passes a check valve 103, is cooled by an aftercooler 104, and afterward, is discharged via configuration in which water is removed. In this example, after the moisture of compressed air that passes the aftercooler 104 is separated in a water separator tank 105, the compressed air passes a minimum pressure valve 106, passes a drier 117 depending upon a specification of a required dew point, the moisture is further removed, and the compressed air is discharged. A water separator element 128 may be also provided in the water separator tank 105 or on the secondary side of the water separator tank. For the after cooler 104, a heat exchanger is used, for example, the heat of the compressed air is exchanged for wind sent from a cooling fan not shown, and the compressed air is cooled.

In operation without water injection, the temperature of fluid discharged from the air end exceeds a boiling point of water to be approximately 200° C., however, operation without water injection is enabled by arranging the aftercooler 104 between the air end 1 and the water separator tank 105 and cooling the temperature of fluid at an entrance of the water separator tank below 100° C. equivalent to the boiling point of water.

That is, according to this configuration, operation with water injection and operation without water injection are enabled with one compressor.

Water injected into the air end 1 flows as follows.

Water is injected into the air end 1 by opening an injection control valve 107. The injected water passes the check valve 103 together with the compressed fluid, is cooled by the aftercooler 104, and is separated in the water separator tank 105. The separated moisture is purified in a strainer 108 and a water filter 109 and is injected into the air end 1 again according to an open degree of the injection control valve 107.

As described above, a water supply path (shown by a broken line in FIG. 1) that makes the water separator tank 105 and the suction side of the air end 1 communicate is provided, water in the water separator tank 105 is supplied to the air end 1 via the strainer 108 and the water filter 109 through the water supply path, and water injection is enabled by controlling the injection control valve 107. Besides, as water injected into the air end 1 reaches the water separator tank 105 via the discharge piping together with compressed air as described above, a water circulating path is configured by each passage.

As for a driving system, the air end 1 is driven by the driving force of the motor 100 via the V-belt 17. A variable frequency drive 112 may be also built in a control panel 113 and hereby, the rotating speed of the motor 100 can be adjusted.

As for an air blow-off line, at least either of first one or second one has only to be provided and no air blow-off line may be also provided. The first air blow-off line is provided between the air end 1 and the aftercooler 104 and after high-temperature fluid after compression is cooled utilizing wind discharged from the aftercooler 104 so as to emit the fluid, the fluid is let to pass a water separator 114 and is blown from an air blow-off solenoid valve 115.

The second air blow-off line is provided between the water separator tank 105 and the minimum pressure valve 106 and air is blown by an air blow-off solenoid valve 125 after it passes a water separator 124. When the air blow-off line is provided on the secondary side of the water separator, no aftercooler check valve 116 is required. Besides, when the moisture is fully removed in the water separator tank 105 or in the water separator element 128, the water separator 124 can be omitted. The air blow-off line may be also provided between the aftercooler 104 and the water separator tank 105.

A control system is configured as follows.

When the variable frequency drive 122 is provided, the rotating speed of the motor 100 can be controlled. In the control panel 113, an arithmetic unit 123 to which signals from pressure sensors 118, 119 and temperature sensors 120, 121 are input and which can operate operating time, stop time, the rotating speed directed from the variable frequency drive 122 of the motor 100 and others is built. The activation and the stop of the motor 100, the opening and the closing of the suction throttle valve 102 and the air blow-off solenoid valves 115, 125, the adjustment of an aperture of the injection control valve 107 and the rotating speed directed from the variable frequency drive 122 of the motor 100 can be adjusted by operating the operating time, the stop time, the rotating speed and others. The pressure sensors 118, 119 and the temperature sensors 120, 121 may be also respectively a pressure switch and a temperature switch.

The whole configuration of this example has been described. Next, an example of control will be described. In the following control, detection information from the pressure sensors (118, 119) and count time are used. The detection information is input to a control unit not shown and the count time is also operated by the control unit (needless to say, an external time counter may be also used). Various instructions such as the opening and the closing of various valves, the operation and the stop of the motor and a rotating speed control instruction are also transmitted from the control unit. An operator can input an instruction to operate the compressor and an instruction to stop it from an external device, however, the input information is transmitted to the control unit, and the control unit transmits a control instruction to each control object based upon the input information.

Figure 7:
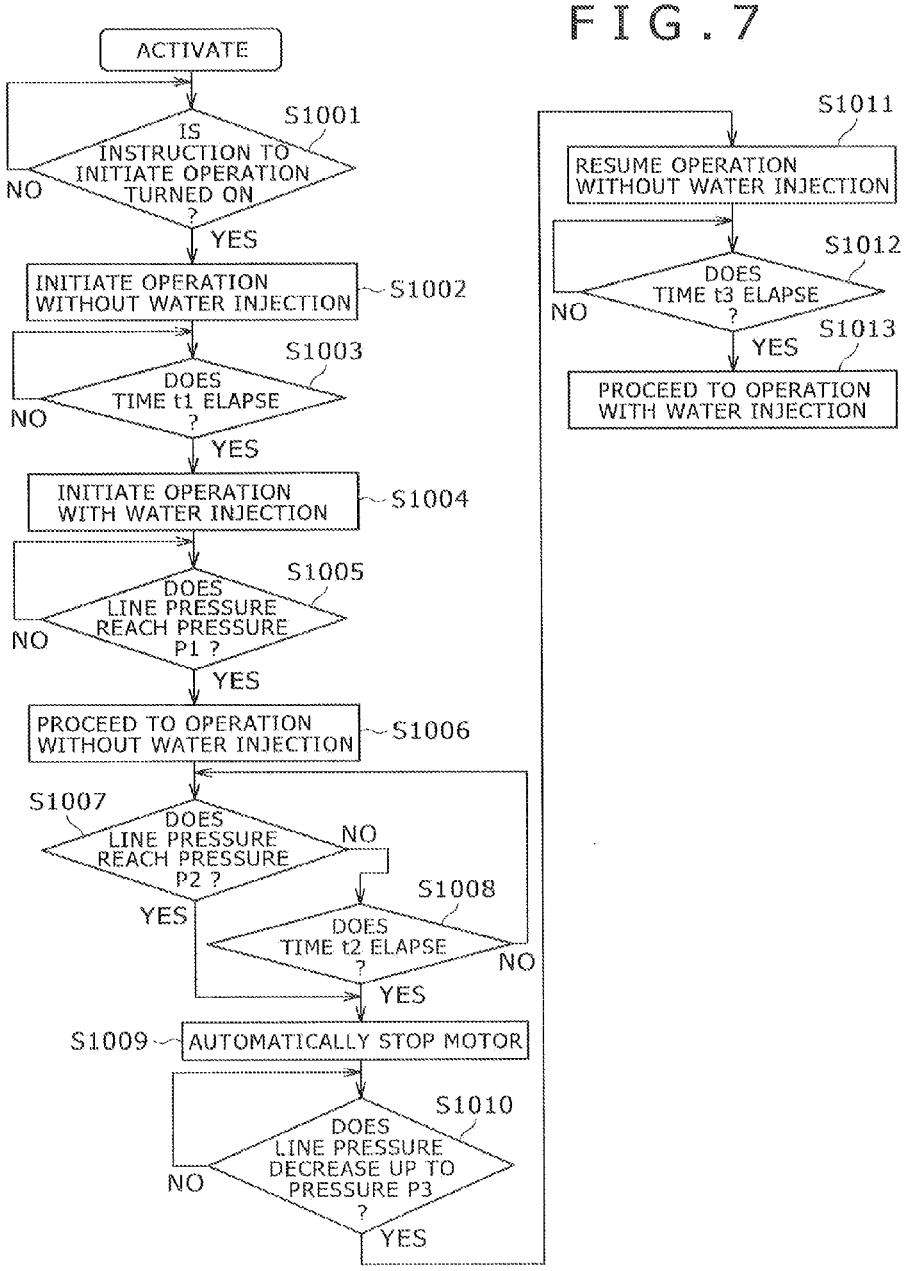
FIG. 7 is a flowchart in the first example of control in this example.
Figure 8:
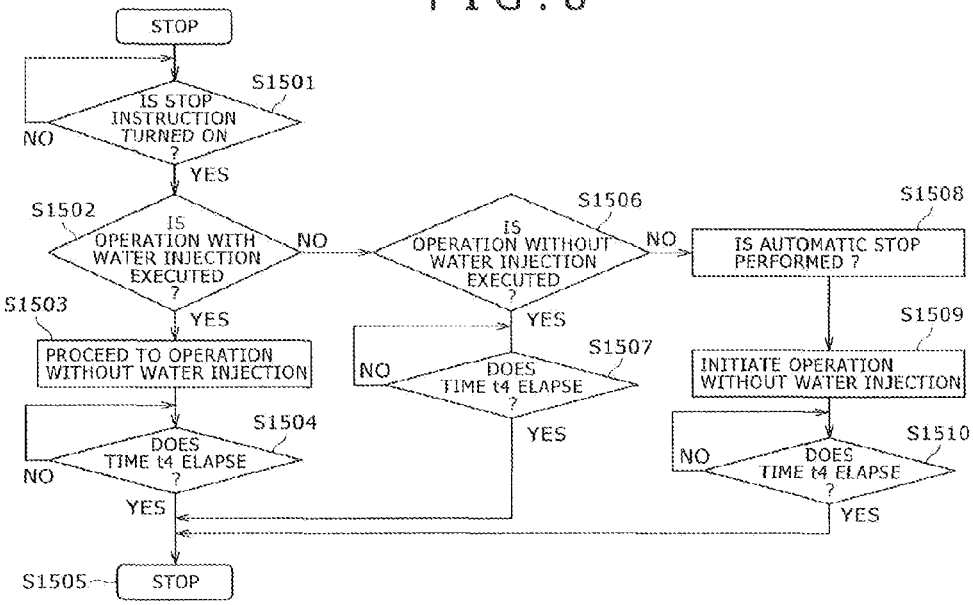
FIG. 8 is a flowchart in the first example of control in this example.

Referring to FIGS. 4, 7 and 8, first control example and operation in this example will be described below.

In the description, a case that configuration is based upon FIG. 1, no air blow-off solenoid valve 115, 125 and no water separator 114, 124 are installed, the aftercooler check valve is not attached, no variable frequency drive is provided to the control system and the suction throttle valve 102 is also not attached is described, however, these may be also provided unless these obstruct this control.

First, referring to FIGS. 4 and 7, the activation and the operation will be described. Line pressure shown by a full line in FIG. 4 is detected by the pressure sensor 119 and pressure at an exit of the air end shown by a broken line with an arrow is detected by the pressure sensor 118, however, the two sensors are not required to be always used and control based upon only line pressure as shown in the example of control is also allowed. The example will be described in detail below.

First, when an instruction to initiate operation is turned on (a step S1001 in FIG. 7) while the compressor is activated, operation without water injection is initiated (S1002). The operation without water injection is performed when the injection control valve 107 is closed.

The operation without water injection is continued for predetermined fixed time t1. When the time t1 elapses after the operation is initiated, the injection control valve 107 is opened and operation with water injection is initiated (S1003 to S1004).

As for the quantity of injected water, it is clarified by verification by the inventors that the efficiency is greatly enhanced with small quantity. An object of this example is also to enhance the efficiency by injecting small quantity of water and control according to the object is made. Concretely, water is injected on the suction side (or into the compression chamber) of the air end in a range in which the ratio of the quantity of injected water that is the ratio in volume of an injected water flow rate to a sucked air flow rate is '5×10−5 to $40\times10^{-5}$' and in a range of the ratio of the quantity of injected water having a characteristic that the increasing width of the whole adiabatic efficiency of the compressor per the increasing width, '$1\times10^{-5}$' of the ratio of the quantity of injected water is below 2%.

Besides, in this example, injected water is controlled using line pressure (or pressure at the exit of the air end). Therefore, injection stop pressure P1 to be a pressure value between cut-out pressure P2 and cut-in pressure P3 that determine a range of supplied pressure is preset.

In control, it is judged whether line pressure reaches the injection stop pressure P1 or not in operation with water injection (S1005), when the line pressure reaches P1, injection is stopped, and the operation with water injection is made to proceed to operation without water injection (S1006).

As sealability between the scroll wraps is lost in operation without water injection, compared with operation with water injection, the quantity of discharged air decreases, a curve showing the rise of pressure is made gentle, and the rise of pressure gradually declines. When time t2 elapses before line pressure reaches P2 in operation without water injection, the motor 100 is stopped. Besides, when line pressure further rises and reaches the cut-out pressure P2 before the time t2 elapses, the motor 100 is also stopped (S1007 to S1009).

Next, as no compressed air is supplied in a state in which the motor 100 is stopped, line pressure decreases when compressed air is used. When line pressure decreases and reaches the cut-in pressure P3, the operation is resumed. Concretely, operation without water injection is resumed (S1010 to S1011).

After the operation is resumed, time is also counted (S1012) and when time t3 elapses, the operation without water injection is made to proceed to operation with water injection (S1013). Afterward, control in which operation with water injection and operation without water injection are repeated is executed by contrasting the pressure P1, P2, P3, the time t2, t3, detected pressure and count time.

Next, control in the stop will be described referring to FIGS. 4 and 8. When a stop instruction is issued in operation (at the timing of T1 in FIG. 4, S1501), it is judged whether operation with water injection is made or not (S1502). As operation with water injection is made in the example shown in FIG. 4, the injection control valve 107 is first closed and after the operation with water injection is made to proceed to operation without water injection (S1503), the motor 100 is stopped after time t4 elapses (S1504 to S1505).

When timing at which the stop instruction is issued is not in operation with water injection, the motor 100 is stopped after the time t4 elapses (S1507 to S1505) as described above in the case of operation without water injection (S1506). Further, when operation with water injection is not made (S1508), operation without water injection is made and the similar control is executed (S1509, S1510, and S1505 in this order).

As operation without water injection is made before a stop by executing stop control as described above, the air end 1 can be dried by heat in compression in the stop and the reliability can be enhanced.

When a stop instruction is issued in the vicinity of the cut-out pressure P2, operation without water injection is also made. At this time, time t4 for operation without water injection is required to be secured. That is, pressure may rise by the operation without water injection and a case that pressure exceeds the cut-out pressure P2 is supposed. Therefore, the cut-out pressure P2 is required to be set to be lower than the actual cut-out pressure P4 of the compressor, for example, the set pressure of a pressure relief valve 127 which is arranged between the minimum pressure valve 106 and the air end 1 (see FIG. 1). In this example, second cut-out pressure P4 is set as a higher pressure value than the cut-out pressure P2 in control and control is made so that line pressure does not exceed P4.

The time t1 used for control in operation and the time t3 may be also the same. Intervals shown as A1 to A5 in FIG. 4 are equivalent to intervals for operation without water injection.

Next, a second example of control and the operation in this example will be described referring to FIGS. 5, 9 and 10. In this example, control in which no-load running by opening the air blow-off solenoid valve is adopted is made.

The configuration is similar to that in the first example of control as to items which are not especially described except that the air blow-off solenoid valve 125 and the water separator 124 are added in addition to the configuration in the first example. Other configurations may also exist in a range in which it is not against this control.

Figure 9:
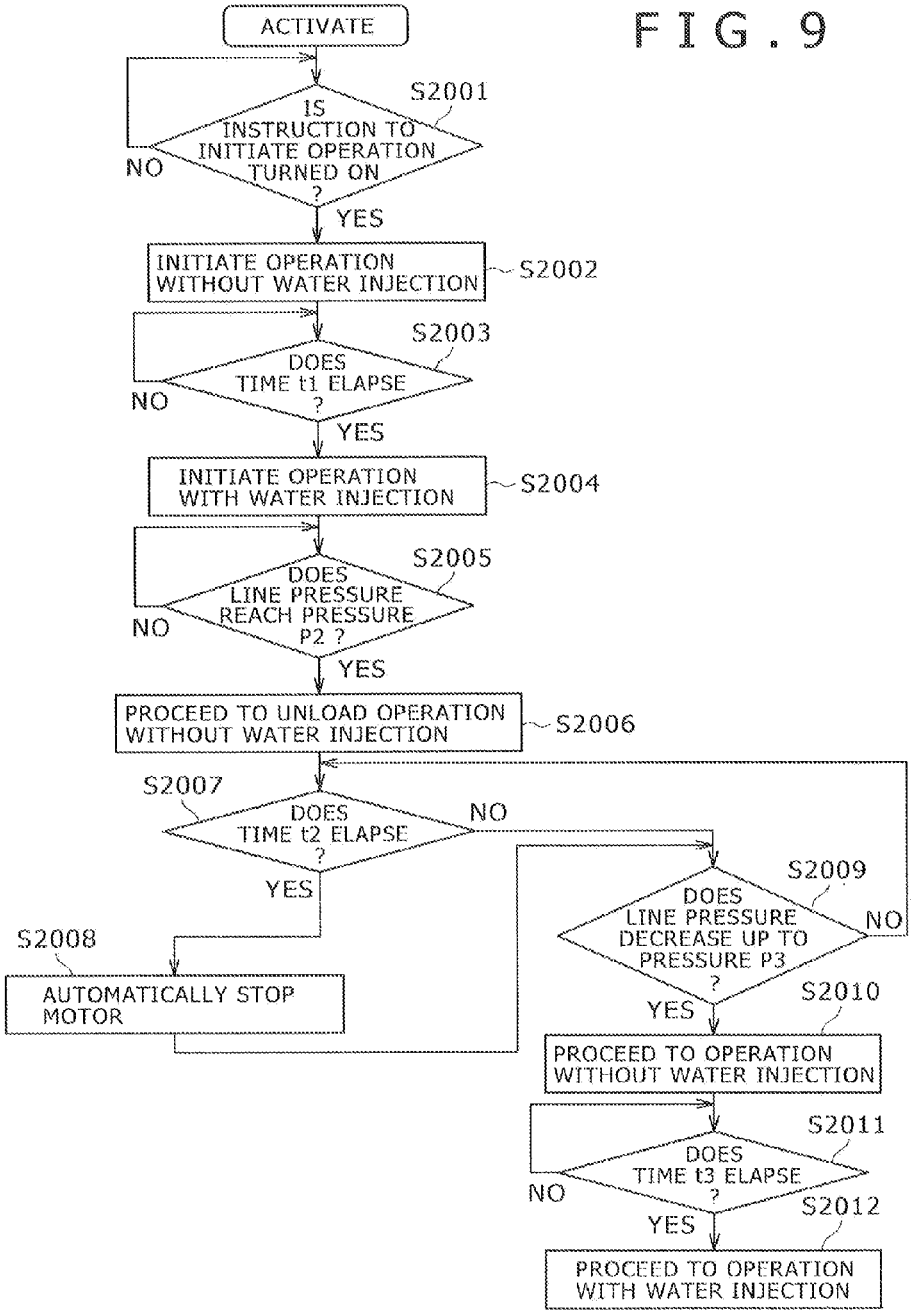
FIG. 9 is a flowchart in the second example of control in this example.
Figure 10:
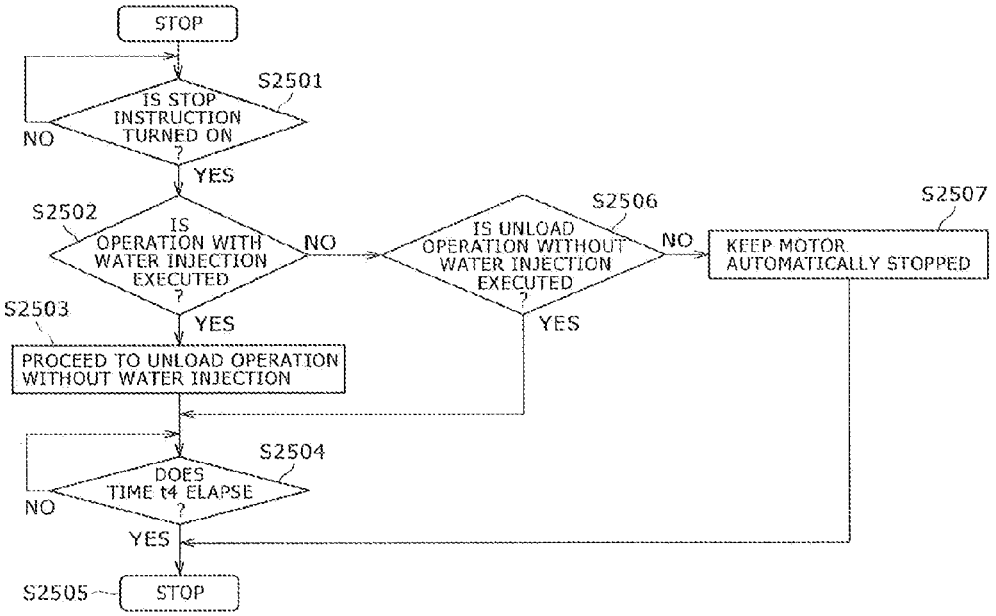
FIG. 10 is a flowchart in the second and third examples of control in this example.

First, the activation and the operation will be first described referring to FIGS. 5 and 9. When an instruction to initiate operation is turned on (a step S2001 in FIG. 9) while the compressor is activated, operation without water injection is initiated (S2002). The operation without water injection is operation in a state in which the air blow-off solenoid valve 125 and the injection control valve 107 are closed. When the time t1 elapses after the operation is initiated, the injection control valve 107 is opened and the operation without water injection is made to proceed to operation with water injection (S2003 to S2004).

When line pressure reaches the cut-out pressure P2 in operation with water injection, water injection is stopped, the air blow-off solenoid valve 125 is further opened, air between the exit of the air end 1 and the minimum pressure valve 106 is blown, and the operation with water injection is made to proceed to unload operation without water injection (S2005 to S2006). The unload operation without water injection is operation in a state in which a load is reduced by opening the air blow-off solenoid valve 125 when the supply of compressed air is not required and in this state, control in which the injection control valve 107 is closed is made. At this time, discharge pressure of the air end 1 is pressure P4 which is balanced by the discharged quantity of compressed fluid and the inside diameter of the air blow-off solenoid valve 125. It need scarcely be said that the pressure P4 is lower than the cut-out pressure P2 and as the pressure P4 is lower than the cut-in pressure P3, a load of the motor 100 is reduced by the quantity.

When the unload operation without water injection continues for predetermined time, it is judged that time in which the supply of compressed air is not required continues and the operation of the compressor is stopped. In the example of this control, the time of the unload operation without water injection is counted and when the time t2 elapses after the unload operation without water injection is initiated, the motor 100 is stopped (S2007 to S2008). At this time, the air blow-off solenoid valve 125 is closed.

When compressed air is used at a destination to which air is supplied in a state in which the motor 100 is stopped, line pressure decreases. When the line pressure decreases up to the cut-in pressure P3, the motor 100 is activated and operation without water injection is resumed (S2008, S2009, and S2010 in this order). When line pressure decreases up to the cut-in pressure P3 before the time t2 elapses in unload operation without water injection, it is also judged that the supply of compressed air is required and operation without water injection is resumed (S2007, S2009, and S2010 in this order).

After the time t3 elapses since operation without water injection is initiated, the operation without water injection is made to proceed to operation with water injection. After the operation with water injection, the similar control to control in the step S2004 and the following steps in FIG. 9 is made, when line pressure reaches the cut-out pressure P2, water injection is stopped, further, the air blow-off solenoid valve 125 is opened, air between the exit of the air end 1 and the minimum pressure valve 106 is blown, and transition to unload operation without water injection is made (S2005 to S2006).

When line pressure decrease up to P3 in the unload operation without water injection, the solenoid valve 125 is closed and the unload operation without water injection is made to proceed to operation with water injection. That is, control in which operation with water injection and operation without water injection are repeated is made by contrasting the pressure P2, P3, the time t3, detected pressure and count time.

Next, control in a stop will be described referring to FIGS. 5 and 10. As operation with water injection is executed in this example when a stop instruction is issued in operation (the timing of T1 in FIG. 5)(S2501), the injection control valve 107 is closed, the air blow-off solenoid valve 125 is opened, and after the operation with water injection is made to proceed to unload operation without water injection (S2502 to S2503), the motor 100 is stopped after the operation without water injection continues for the time t4 (S2504 to S2505). When a stop instruction is turned on in operation without water injection (S2501 to S2502), the injection control valve 107 is kept closed, the air blow-off solenoid valve 125 is opened, and the operation without water injection is made to proceed to unload operation without water injection (S2503). After operation without water injection continues for the time t4, the motor 100 is stopped (S2504 to S2505).

In the meantime, when a stop instruction is issued in unload operation without water injection, the motor 100 is stopped after the time t4 elapses since the stop signal (S2506, S2504, and S2505 in this order). However, when the time of unload operation without water injection is counted and the time t4 already elapses at the time at which the stop instruction is turned on, it is not required that the time t4 elapses, the motor 100 may be also immediately stopped, and when a total value of elapsed time before the stop instruction is turned on and elapsed time after the stop instruction is turned on exceeds t4, the motor may be also stopped. If the motor is automatically stopped when the stop instruction is turned on, the motor is kept stopped as it is (S2507, and S2505 in this order).

Intervals shown by A1 to A4 in FIG. 5 are equivalent to intervals of operation without water injection.

Transition to operation without water injection is enabled by adding the air blow-off solenoid valve 125 to the configuration in the first example as described above without exceeding the cut-out pressure and the further sufficient time of operation without water injection can be secured.

Figure 11:
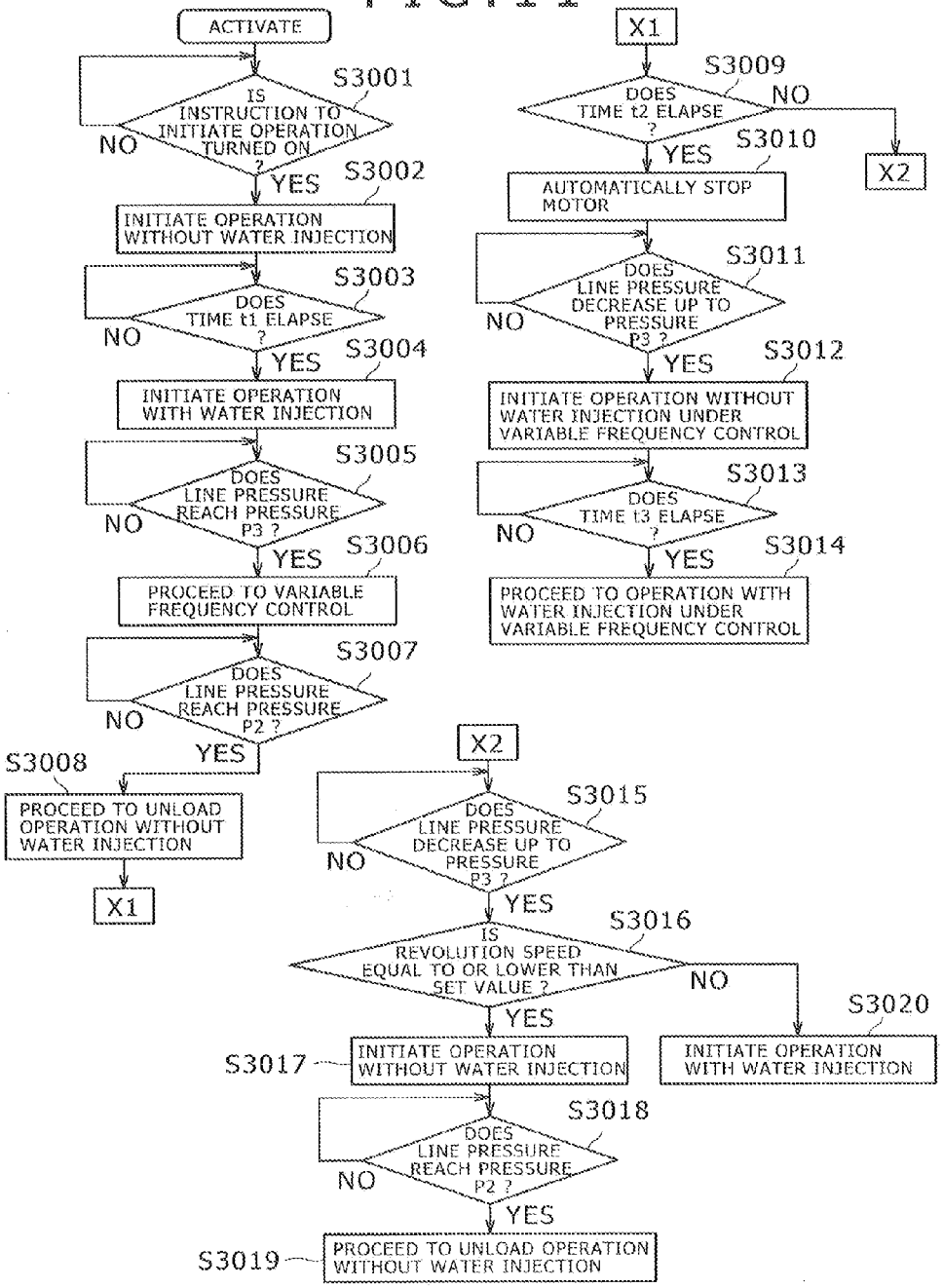
FIG. 11 is a flowchart in the third example of control in this example.

Next, a third example of control and the operation in this example will be described referring to FIGS. 6 and 11. A flow for a stop is similar to that in FIG. 10. As for the configuration, the variable frequency drive 122 is added to the configuration in the second example of control. That is, control over the rotating speed of the motor 100 is enabled. Items which are not especially described are similar to those in the second example of control. Other configurations may also exist in a range in which it is not against this control.

When an instruction to initiate operation is turned on in activation, operation without water injection is initiated in a state in which the air blow-off solenoid valve 125 is closed and the injection control valve 107 is closed (S3001 to S3002). When the time t1 elapses after the operation is initiated, the injection control valve 107 is opened and the operation without water injection is made to proceed to operation with water injection (S3003 to S3004).

When pressure rises and line pressure reaches control pressure (equivalent to the cut-in pressure in this control) P3, pressure fixing control according to load fluctuation is executed according to variable frequency control (S3006). That is, as the variable frequency drive 122 is mounted in this example of control, the rotating speed of the motor 100 can be controlled according to an air flow rate required by a customer and hereby, control in which pressure is fixed at the control pressure P3 is enabled.

In a case that only a small quantity of an air flow rate is required and line pressure rises even at the minimum rotating speed of the motor by the variable frequency drive 122, when the line pressure reaches the cut-out pressure P2, the injection control valve 107 is closed and the air blow-off solenoid valve 125 is opened, and the operation is made to proceed to unload operation without water injection (S3007 to S3008). At this time, it is desirable that the rotating speed of the motor 100 is kept at minimum rotating speed by the variable frequency drive 122.

In the unload operation without water injection, when the time t2 elapses in a state in which line pressure is not reduced up to P3, it is judged that the supply of air is not required and the motor 100 is stopped (S3009 to S3010). When compressed air is used at a destination to which air is supplied in this state, line pressure decreases. When line pressure reaches the control pressure (the cut-in pressure) P3, operation is resumed. In this example of control, when the injection control valve 107 is closed, operation without water injection is resumed (S3011 to S3012) and the time t3 elapses after the operation is resumed, the operation without water injection is made to proceed to operation with water injection (S3013 to S3014). Afterward, control is returned to the step S3006 and when line pressure reaches P2, the operation with water injection is made to proceed to unload operation without water injection (S3007 to S3008).

Next, control when pressure decreases up to the cut-in pressure P3 (equivalent to an interval A3 in FIG. 6) before the time t2 elapses after the pressure reaches the pressure P2 and transition to the unload operation without water injection is made will be described. In this control, it is desirable that a control parameter of the rotating speed of the motor 100, that is, a rotating speed instructed value from the variable frequency drive 122 is introduced. This parameter shall be a set value determined as an instructed value between a rotating speed instructed cut-out value and a rotating speed instructed cut-in value.

When pressure decreases up to P3 before the time t2 elapses, the rotating speed of the motor 100 further controlled by the variable frequency drive 122 and the set value are contrasted (S3009, S3015, and S3016 in this order). When the rotating speed is slower than the set value, the air blow-off solenoid valve 125 is closed and operation is made to proceed to operation without water injection (S3017). In the meantime, when pressure decreases up to P3 and further, the rotating speed of the motor 100 is faster than the set value, water injection is initiated and pressure fixing control is made (S3015, S3016, and S3020 in this order).

As pressure fixing control is enabled at the control pressure (the cut-in pressure) P3 by adding the variable frequency drive 122 as described above, energy can be saved. Besides, as operation without water injection is executed at the minimum rotating speed of the motor at the interval A3, the time of operation without water injection after a stop instruction can be minimized when the stop instruction is issued and energy can be saved. Besides, if the motor is also revolved at the minimum rotating speed in operation without water injection after the stop instruction, energy can be saved, compared with a case that no variable frequency drive is provided. Intervals shown as A1 to A4 in the drawing are equivalent to intervals of operation without water injection.

The effects of energy saving that pressure fixing control at the cut-in pressure is enabled and the cut-out pressure P2 can be set to be lower are acquired by comparing with the second example of control and adding the variable frequency drive 122.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

What is claimed is:

1. A water injected air compressor comprising:

an air end comprising a compressing member and a compressing path from a suction port to a discharge port, into which water is injected, a pressure detector that detects pressure of compressed gas discharged from the compressing path: and a driving unit that generates driving force for the compressing member; wherein operation is controlled by switching operation in which water is injected into the compressing path and operation in which no water is injected according to detection of a predetermined pressure value by the detector; and after the operation in which water is injected is switched to the operation in which no water is injected, the driving unit is stopped after a certain period of time lapses.

2. The water injected air compressor according to claim 1, wherein after the operation of the driving unit is initiated, the injection of water is initiated.

3. The water injected air compressor according to claim 1, wherein when a stop instruction is issued, the operation in which water is injected is switched to the operation in which no water is injected and the driving unit is stopped after the certain period of time lapses.

4. The water injected air compressor according to claim 1, further comprising:

an arithmetic unit that operates the pressure detector and its operating time; wherein after time according to a result of the operation based upon a parameter of the pressure and the operating time elapses after the driving unit is activated, the injection into the compressing path of water is initiated.

5. The water injected air compressor according to claim 1, wherein at the same time that the driving unit is stopped or before it is stopped, the injection into the compressing path of water is stopped.

6. The water injected air compressor according to claim 1, further comprising:

an arithmetic unit that operates the pressure detector and its operating time; wherein the injection into the compressing path of water is stopped or is reduced during the operation based upon the detected pressure and the operating time.

7. The water injected air compressor according to claim 1, wherein when the rotating speed of the driving unit is low, the injection into the compressing path of water is stopped.

8. The water injected air compressor according to claim 1, further comprising:

a check valve or a minimum pressure valve provided to a path where air of the compressor passes; wherein after the injection of water into the compressing path is stopped during the operation, the operation is continued to blow-off air on the primary side of the check valve or the minimum pressure valve into the atmosphere.

9. The water injected air compressor according to claim 8, wherein before blow-off air is blown into the atmosphere, the blow-off air passes a water separator.

10. The water injected air compressor according to claim 1, further comprising:

a suction throttle valve provided on the suction side of the compressor; wherein when the injection of water is stopped, the suction throttle valve is closed.

11. The water injected air compressor according to claim 1, wherein the compressing member is made of an aluminum alloy.

12. The water injected air compressor according to claim 1, wherein pressure for stopping water injection is set to be equal to or lower than cut-out pressure in capacity control.

13. The water injected air compressor according to claim 1, wherein when a stop instruction from the field or a multi unit control panel, and according to scheduled operation not necessarily linked with the information of the detected pressure, are input, operation with water injection is made to proceed to operation without water injection or operation without water injection is continued and the driving unit is stopped after the certain time period elapses.

14. The water injected air compressor according to claim 1, wherein when stop instructions from the field or a multi unit control panel, and according to scheduled operation, are input, the driving unit is automatically stopped and operation without water injection is initiated.

15. The water injected air compressor according to claim 1, wherein the driving unit that generates driving force is a motor.

16. The water injected air compressor according to claim 1, wherein:

when an automatically stopped state is continued, operation without water injection is executed for a fixed time; and blow-off air is blown into the atmosphere from the primary side of a check valve or a minimum pressure valve.

* * * * *